US008786435B2

(12) United States Patent
Barnett et al.

(10) Patent No.: US 8,786,435 B2
(45) Date of Patent: Jul. 22, 2014

(54) SECURITY SYSTEM INCLUDING WIRELESS SELF-ENERGIZING SWITCH

(75) Inventors: Thomas Alan Barnett, Ypsilanti, MI (US); John Gerard Finch, Livonia, MI (US)

(73) Assignee: Enocean GmbH, Oberhaching (DE)

( * ) Notice: Subject to any disclaimer, the term of this patent is extended or adjusted under 35 U.S.C. 154(b) by 447 days.

(21) Appl. No.: 12/667,921

(22) PCT Filed: Jul. 22, 2008

(86) PCT No.: PCT/US2008/070720

§ 371 (c)(1), (2), (4) Date: Jan. 6, 2010

(87) PCT Pub. No.: WO2009/020762

PCT Pub. Date: Feb. 12, 2009

(65) Prior Publication Data

US 2011/0006896 A1 Jan. 13, 2011

Related U.S. Application Data

(60) Provisional application No. 60/954,007, filed on Aug. 5, 2007.

(51) Int. Cl.
*G08B 13/00* (2006.01)
*H05B 37/02* (2006.01)

(52) U.S. Cl.
CPC ..... *H05B 37/0272* (2013.01)
USPC ..... 340/541; 340/540; 340/506; 340/565

(58) Field of Classification Search
CPC ..... G06F 2221/2151; G06F 21/86; G06F 21/554; G06F 21/55; G06F 21/566; G06F 11/3438
USPC ..... 340/539.1–539.11, 539.14–539.15, 340/540, 545.3–545.4
See application file for complete search history.

(56) References Cited

U.S. PATENT DOCUMENTS 3,614,760 A * 10/1971 Zimmet et al. ..... 340/539.3
3,781,836 A * 12/1973 Kruper et al. ..... 340/539.3

(Continued)

FOREIGN PATENT DOCUMENTS

EP 0656612 A1 6/1995
JP 2002-015380 1/2002

(Continued)

OTHER PUBLICATIONS

Search Report and Written Opinion mailed on Dec. 5, 2008 for PCT/US2008/070699.

(Continued)

*Primary Examiner* — Daniel Wu
*Assistant Examiner* — Son M Tang
(74) *Attorney, Agent, or Firm* — Foley & Lardner LLP; Edward A. Gordon

(57) ABSTRACT

A wireless security system includes a power supply and a security device in selective electrical communication with the power supply. The security device provides a security response when electrically connected with the power supply. A receiver is electrically connected between the power supply and the security device and is operable to selectively electrically connect the security device with the power supply. At least one self-energizing switch of the system includes a wireless transmitter and an energy harvester that is operable to power the wireless transmitter. The wireless transmitter emits a signal to the receiver in response to power from the energy harvester, to trigger the security response.

14 Claims, 5 Drawing Sheets

(56) References Cited

U.S. PATENT DOCUMENTS

| | | | | |
|---|---|---|---|---|
| 3,827,038 | A * | 7/1974 | Willis | 340/520 |
| 3,980,996 | A * | 9/1976 | Greenspan et al. | 340/539.3 |
| 4,365,238 | A | 12/1982 | Kolin | |
| 4,400,696 | A | 8/1983 | Klingensmith | |
| 4,538,139 | A * | 8/1985 | Clemente | 340/539.3 |
| 4,612,472 | A * | 9/1986 | Kakizaki et al. | 310/339 |
| 5,099,193 | A * | 3/1992 | Moseley et al. | 323/324 |
| 5,191,265 | A | 3/1993 | D'Aleo et al. | |
| 5,317,303 | A * | 5/1994 | Ross et al. | 340/539.26 |
| 5,475,369 | A * | 12/1995 | Baker | 340/573.3 |
| 5,499,013 | A * | 3/1996 | Konotchick | 340/539.22 |
| 5,572,190 | A * | 11/1996 | Ross et al. | 340/541 |
| 5,576,690 | A * | 11/1996 | Waugh et al. | 340/539.1 |
| 5,586,048 | A * | 12/1996 | Coveley | 702/189 |
| 5,717,203 | A * | 2/1998 | Yung | 250/221 |
| 6,174,073 | B1 * | 1/2001 | Regan et al. | 362/249.13 |
| 6,259,372 | B1 * | 7/2001 | Taranowski et al. | 340/683 |
| 6,445,302 | B2 | 9/2002 | Vena | |
| 6,460,183 | B1 * | 10/2002 | Van Der Vleuten | 725/139 |
| 6,630,894 | B1 * | 10/2003 | Boyd et al. | 341/22 |
| 6,700,310 | B2 * | 3/2004 | Maue et al. | 310/339 |
| 6,715,730 | B2 * | 4/2004 | Ehr | 251/129.04 |
| 6,737,969 | B2 | 5/2004 | Carlson et al. | |
| 6,775,523 | B2 | 8/2004 | Bentley | |
| 6,776,334 | B1 * | 8/2004 | Garg | 235/384 |
| 6,778,086 | B2 | 8/2004 | Morrone et al. | |
| 6,828,909 | B2 | 12/2004 | Script et al. | |
| 6,933,655 | B2 * | 8/2005 | Morrison et al. | 310/314 |
| 6,952,165 | B2 | 10/2005 | Kovach et al. | |
| 7,005,778 | B2 | 2/2006 | Pistor | |
| 7,019,241 | B2 | 3/2006 | Grassl et al. | |
| 7,084,529 | B2 * | 8/2006 | Face et al. | 307/116 |
| 7,085,534 | B2 | 8/2006 | Bentley | |
| 7,122,944 | B2 * | 10/2006 | Grimshaw | 310/339 |
| 7,126,497 | B2 * | 10/2006 | Face et al. | 341/20 |
| 7,161,276 | B2 * | 1/2007 | Face | 310/314 |
| 7,170,407 | B2 | 1/2007 | Wagner | |
| 7,268,517 | B2 * | 9/2007 | Rahmel et al. | 320/101 |
| 7,389,674 | B2 | 6/2008 | Bulst et al. | |
| 7,692,559 | B2 * | 4/2010 | Face et al. | 341/20 |
| 7,733,224 | B2 * | 6/2010 | Tran | 340/540 |
| 8,011,255 | B2 * | 9/2011 | Arms et al. | 73/862.325 |
| 8,033,686 | B2 * | 10/2011 | Recker et al. | 362/249.02 |
| 2003/0016089 | A1 | 1/2003 | Cousy et al. | |
| 2003/0045239 | A1 | 3/2003 | Buckingham et al. | |
| 2003/0193417 | A1 | 10/2003 | Face et al. | |
| 2003/0206103 | A1 | 11/2003 | Morrone et al. | |
| 2004/0124741 | A1 | 7/2004 | Morrison et al. | |
| 2005/0024207 | A1 | 2/2005 | Schebel et al. | |
| 2005/0073221 | A1 * | 4/2005 | Albsmeier et al. | 310/339 |
| 2005/0073405 | A1 | 4/2005 | Spoltore et al. | |
| 2005/0095984 | A1 | 5/2005 | Buckingham et al. | |
| 2005/0253486 | A1 | 11/2005 | Schmidt | |
| 2006/0012317 | A1 * | 1/2006 | Chiu et al. | 315/294 |
| 2006/0033597 | A1 | 2/2006 | Wells | |
| 2007/0182543 | A1 * | 8/2007 | Luo | 340/521 |
| 2008/0018435 | A1 | 1/2008 | Brown | |
| 2008/0070652 | A1 * | 3/2008 | Nguyen et al. | 463/1 |
| 2009/0243842 | A1 * | 10/2009 | Mitchell et al. | 340/539.26 |

FOREIGN PATENT DOCUMENTS

| | | | |
|---|---|---|---|
| JP | 2003-296827 | A | 10/2003 |
| JP | 2004-092122 | A | 3/2004 |
| JP | 2005-036572 | A | 2/2005 |
| JP | 2005-126996 | A | 5/2005 |
| JP | 2005-322008 | A | 11/2005 |
| JP | 2006-037344 | A | 2/2006 |
| JP | 2006-235724 | A | 9/2006 |
| JP | 2006-303933 | | 11/2006 |
| JP | 2006-333049 | | 12/2006 |
| WO | WO03005388 | A2 | 1/2003 |
| WO | WO2006111934 | A1 | 10/2006 |
| WO | WO-2007-037830 | | 4/2007 |
| WO | WO2007072325 | A2 | 6/2007 |

OTHER PUBLICATIONS

Search Report and Written Opinion mailed on Oct. 27, 2008 for PCT/US2008/070720.

Notification of Transmittal of the International Preliminary Report on Patentability mailed on Nov. 16, 2009 for PCT/US2008/070720.

Search Report and Written Opinion mailed on Jan. 22, 2009 for PCT/US2008/071120.

Notification of Transmittal of the International Preliminary Report on Patentability mailed on Nov. 11, 2009 for PCT/US2008/071120.

Search Report and Written Opinion mailed on Oct. 27, 2008 for PCT/US2008/070700.

Notification of Transmittal of the International Preliminary Report on Patentability mailed on Nov. 16, 2009 for PCT/US2008/070700.

Search Report and Written Opinion mailed on Jan. 22, 2009 for PCT/US2008/071124.

Notification of Transmittal of the International Preliminary Report on Patentability mailed on Nov. 3, 2009 for PCT/US2008/071124.

PCT Patent Application "Wireless Switching Applications", Application No. PCT/US2008/070699 filed on Jul. 22, 2008.

http:/www.castlewholesalers.com/HEATH-ZENITH-SL-6162-Wireless-F-B-Door-Chime-Off-White.html.

PCT Patent Application "Notification System Utilizing Self-Energizing Switches", Application No. PCT/US2008/071120 filed on Jul. 25, 2008.

PCT Patent Application "Door Notification System", Application No. PCT/US2008/70700 filed on Jul. 22, 2008.

PCT Patent Application "Wireless Scene Arrangement", Application No. PCT/US2008/071124 filed on Jul. 25, 2008.

* cited by examiner

SECURITY SYSTEM INCLUDING WIRELESS SELF-ENERGIZING SWITCH

CROSS-REFERENCE TO RELATED APPLICATIONS

This disclosure is the U.S. National stage of PCT Application No. PCT/US2008/070720, filed on Jul. 22, 2008, which claims priority to U.S. Provisional Application Ser. No. 60/954,007 filed on 5 Aug. 2007. The entire contents of the foregoing applications are hereby incorporated herein by reference.

BACKGROUND OF THE INVENTION

This disclosure relates to security systems and, more particularly, to a security system utilizing at least one self-energizing switch.

Wireless switches typically utilize a battery to power an internal transmitter. For example, such wireless switches have been used in certain switching applications that permit easy access to change the batteries, such a wireless garage door opener. In other switch applications, battery access is limited or completely unfeasible. For instance, a light switch may be recessed into a wall and require considerable labor to disassemble, or a security sensor switch may be in an elevated location or out of easy reach.

SUMMARY OF THE INVENTION

An example wireless security system includes a power supply and a security device in selective electrical communication with the power supply. The security device provides a security response when electrically connected with the power supply. A receiver is electrically connected between the power supply and the security device and is operable to selectively electrically connect the security device with the power supply. At least one self-energizing switch of the system includes a wireless transmitter and an energy harvester that is operable to power the wireless transmitter. The wireless transmitter emits a signal to the receiver in response to power from the energy harvester, to trigger the security response.

In another aspect, the wireless security system includes a memory module in communication with the receiver. The memory module is capable of recording an activity pattern of the building light over a first time period. The receiver may then later selectively electrically connect the security device with the power supply over a second time period, to repeat the activity pattern as a security response.

An example method for use with a wireless security system includes recording in a memory module an activity pattern over a first time period for at least one security device, and selectively electrically connecting the at least one security device with a power supply over a second time period to repeat the activity pattern.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
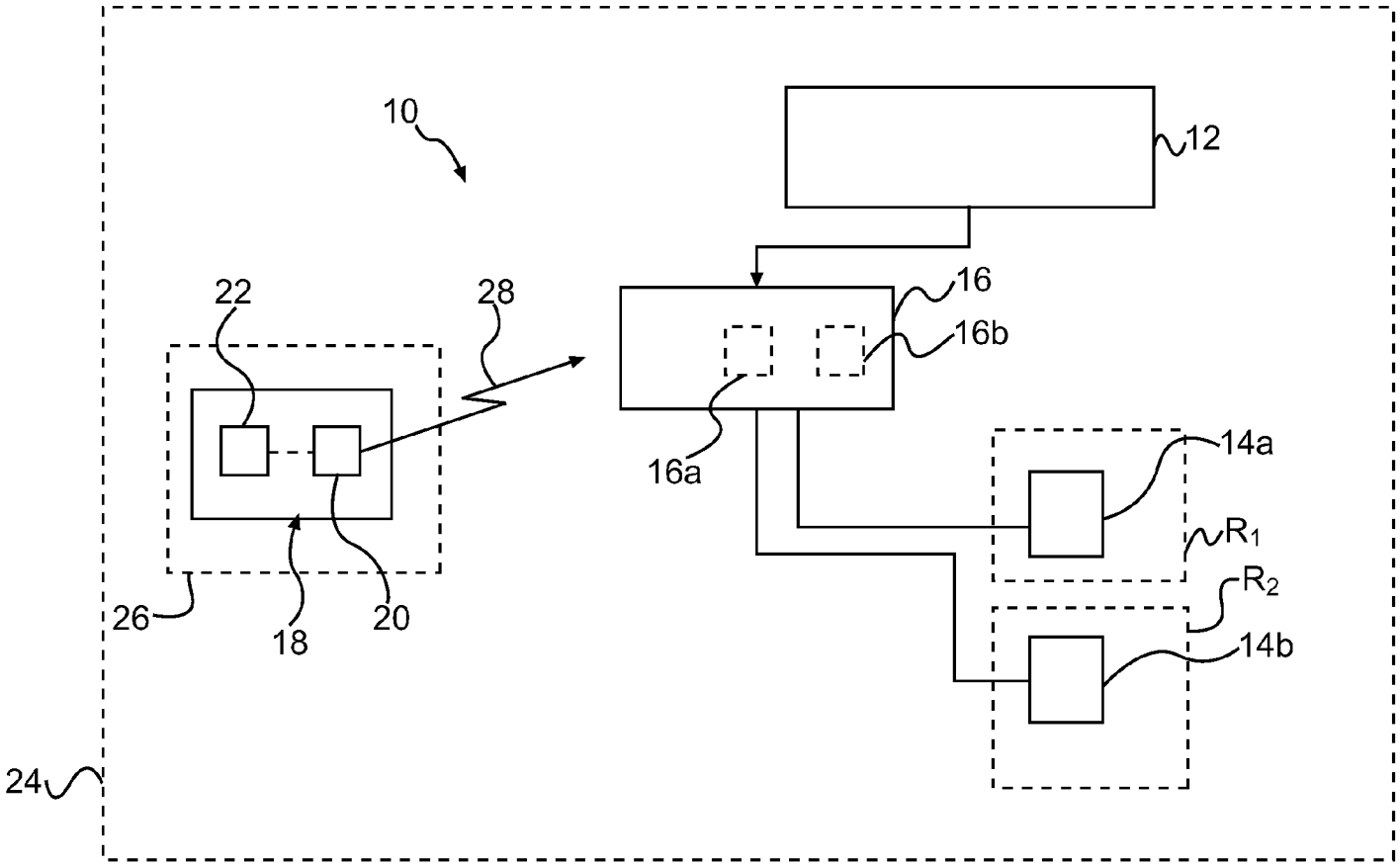
FIG. 1 schematically illustrates an example wireless security system.

FIG. 1 schematically illustrates selected portions of an example wireless security system 10 for providing a security response, such as in response to a security event (e.g., criminal, non-criminal, property damage, etc.). In the illustrated example, the wireless security system 10 includes a power supply 12 and a security device 14*a* in selective electrical communication with the power supply 12, as indicated generally by the connecting lines.

The wireless security system 10 also includes a receiver 16 that is electrically connected between the power supply 12 and the security device 14*a*. For example, the receiver 16 is capable of selectively electrically connecting the security device 14*a* with the power supply 12. For instance, the receiver 16 may include hardware, software, or both for serving this function. The receiver 16 may be a single channel receiver for controlling operation of the security device 14*a*, or a multi-channel receiver capable of controlling operation of one or more additional security devices, such as security device 14*b*. As an example, the receiver 16 may be EnOcean product number RCM 130C.

Additionally, the wireless security system 10 includes a self-energizing sensor 18 for communicating with the receiver 16. The self-energizing sensor 18 includes a wireless transmitter 20 and an energy harvester 22 that is operable to power the wireless transmitter 20. For instance, the self-energizing sensor 18 harvests external energy (relative to the self-energizing sensor 18), such as movement of a door, solar energy, etc., using the energy harvester 22. The energy harvester 22 may be a piezoelectric element, a photovoltaic device, or other type of energy conversion device that is capable of receiving energy from the external surroundings of the self-energizing sensor 18 and converting that energy into electricity to power the wireless transmitter 20. Thus, the use of any such type of device is contemplated within the self-energizing sensor 18. As an example, the self-energizing sensor 18 may be EnOcean product number PTM 250.

The wireless transmitter 20 is operable to emit a signal to the receiver 16, such as a radio frequency ("RF") signal, in response to power from the energy harvester 22, to trigger the security response. In this regard, the self-energizing sensor 18 may include hardware (e.g., timing circuits, logic circuits, a micro-processor, etc.), software, or both with the wireless transmitter 20 for providing a desired type of signal, such as a coded signal that identifies the particular self-energizing sensor 18, or providing "smart" capability that monitors the amount of power harvested and/or controls powering of the wireless transmitter 20.

In some examples, the receiver 16 may also include additional components that enhance the operation of the wireless security system 10. For instance, the receiver 16 may include a software module 16*a* and/or a memory module 16*b*. The software module 16*a* may facilitate analyzing signals received into the receiver 16 from one or more self-energizing sensors 18. In examples where there are several self-energizing sensors 18 and/or several security devices 14*a* and 14*b*, the software module 16*a* identifies a received signal with a particular one of the self-energizing sensors 18 (e.g., from a coded signal) and a desired output security response. For instance, in response to a signal from one self-energizing sensor 18, the software module 16*a* may determine that the security device 14*a* should be activated, and in response to a signal from another one of the self-energizing sensors 18, the software module 16*a* may determine that the security device 14*b* should be activated. Therefore, the software module 16*a* allows the receiver 16 to manage a multiple self-energizing sensors 18 and multiple different security response outputs.

In the illustrated example, the wireless security system 10 is associated with a building structure 24 for monitoring the security thereof. In this regard, the security system 10 may be used in a variety of different ways to monitor security. As will be further illustrated in the disclosed examples, the self-energizing sensor 18 may be coupled to a portion 26 of the building structure 24, such as a window, door, drawer, gate or other portion 26 that would benefit from security monitoring. In response to being energized due to a security event, the self-energizing sensor 18 emits a wireless signal 28 to the receiver 16 that triggers the security device 14*a* and/or 14*b* to provide the security response.

The type of security response provided is not limited to any particular type and may include, for example, visual indications, audible indications, communications, or even mechanical responses. As illustrated by the following non-limiting examples, the wireless security system 10 may be utilized in a variety of different ways.

Additionally, the security devices 14*a* and 14*b* are not limited to any particular type and may be visual indicators, audible devices, communications devices, or mechanical devices. For example, the security devices 14*a* or 14*b* may be a building light, an auditory devices, signals to a security authority, powered locks, a security system, building water valves, or an inter-room indicator system having indicators located in different rooms $R_1$ and $R_2$ of the building structure 24. The indicators provide indication in the rooms $R_1$ and $R_2$ that there is a security event relative to the portion 26 of the building structure 24. For instance, if the self-energizing sensor 18 is incorporated into a gate or door, activation of the indicators in rooms $R_1$ and $R_2$ may indicate that someone has arrived or left the building structure 24.

In some examples, the self-energizing sensor 18 may be portable such that the security response can be triggered from different locations within the building structure 24 (e.g., remotely from the receiver 16 and the security devices 14*a* and 14*b*). For example, the self-energizing switch may be a hand-held device that may be carried from room to room within the building structure 24 or locally around the property of the building structure 24, depending upon the range of the wireless transmitter 20. In one example, the self-energizing sensor 18 may be used as a "panic" button that an individual carries to activate a security response when there is a security event. For instance, the security response may be in the form of activating a home security system or signaling to a security authority (e.g., a security company).

In some examples, the memory module 16*b* may be used to record activity of the security devices 14*a* or 14*b* over a time period. The memory module 16 may be any type of memory device, such as a solid state memory device, flash device, or the like. The memory module 16*b* may be functionally connected with the security devices 14*a* or 14*b* to record an activity pattern over a time period, such as a week. That is, the memory module 16*b* may cooperate with the software module 16*a* through the receiver 16 to monitor and record activity of the security devices 14*a* or 14*b*. The activity pattern may be any type of pattern, such as a lighting pattern of building lights, but may also include use patterns of other devices such as televisions, radios, etc. that might simulate occupancy in a building.

In one example, building occupants may turn the lights on in the evenings, and turn the lights off later in the evening, or turn lights on/off when entering/leaving rooms. The memory module 16*b* may be activated and deactivated using the self-energizing sensor 18 to begin and end recording of the ON and OFF activity of the lights over a time period. The self-energizing sensor 18 may also be used to begin a later, second time period to replay the ON and OFF activity, in which the receiver 16 selectively electrically connects the light with the power supply 12 according to the lighting pattern of the lights as a security response. Thus, the memory module 16*b* could record activity over a time when occupants are at home, and replay lighting pattern when the occupants are not at home to simulate occupancy. In some examples, the memory module 16*b* may continually record activity over a rolling time period extending from a present time back to a preset amount of time in the past (e.g., one week).

The following examples illustrate additional implementations of the wireless security system 10. FIG. 2A illustrates an example implementation of a wireless security system 100 that is somewhat similar to the wireless security system 10 described in the example of FIG. 1. In this disclosure, like reference numerals designate like elements where appropriate, and reference numerals with the addition of one hundred or multiples thereof designate modified elements. It is to be understood that the modified elements incorporate the same features and benefits of the corresponding original elements, except where stated otherwise. In this example, the wireless security system 100 includes a security device 114*a* that is a building light bulb. A receiver 116 is electrically connected between a power supply 112 and the building light bulb for selectively electrically connecting the building light bulb with the power supply to illuminate. A self-energizing sensor 118 is mechanically coupled with a window 131. For example, the window 131 may be within the building structure 24 of the prior example.

The window 131 includes a movable section 133 that may slide up or down to respectively open or close the window 131. Movement of the moveable section 133 mechanically activates the self-energizing sensor 118. When activated, the energy harvester 122 of the self-energizing sensor 118 powers the wireless transmitter 120, which responsively emits a signal to the receiver 116. In response to the signal, the receiver 116 triggers a security response by controlling the electrical connection between the building light bulb and the power supply 112. For instance, opening movement of the window 131 may illuminate the building light bulb and closing movement may shut off the building light bulb. In other examples, the receiver 116 may intermittently illuminate the building light bulb for a flashing effect as the security response.

Figure 2B:
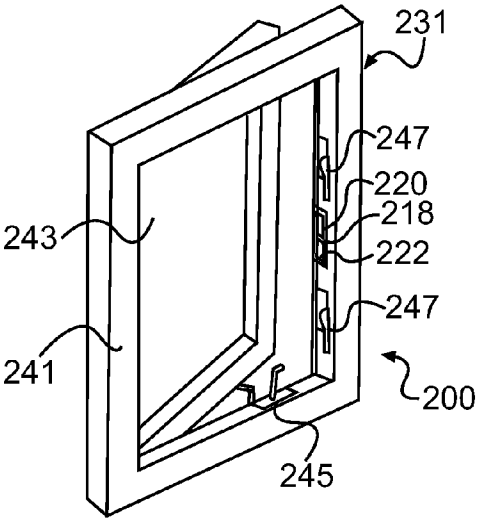
FIG. 2B illustrates another example window.
Figure 2C:
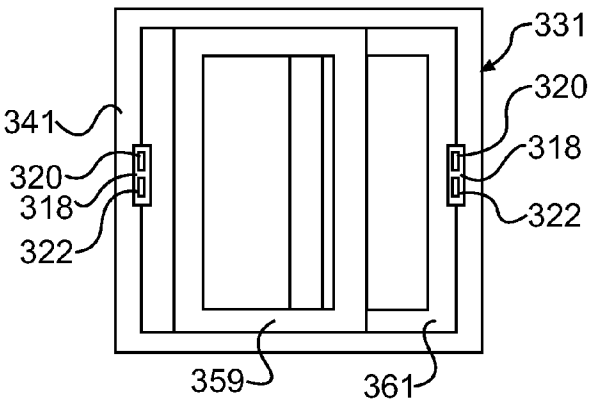
FIG. 2C illustrates another example window.
Figure 2A:
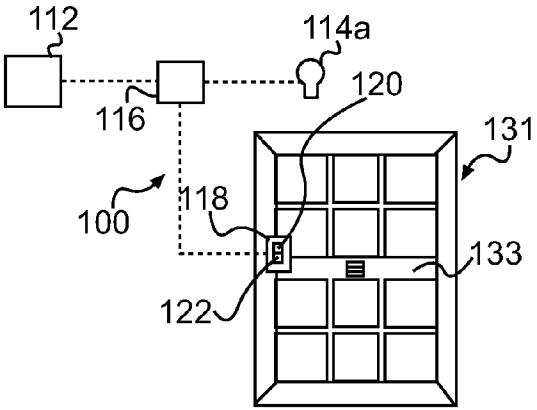
FIG. 2A illustrates an example wireless security system used with a window.

As illustrated in FIG. 2B, a self-energizing sensor 218 may be coupled to other types of windows than the window 131 illustrated in FIG. 2A. In this example, the self-energizing sensor 218 is coupled to a casement window 231 that includes a frame 241 and a movable pane 243. The movable pane can be opened and closed utilizing a rotating crank 245. A plurality of latches 247 may be used to lock the movable pane 243 with respect to the frame 241. The self-energizing sensor 218 is coupled to the frame 241. Movement of the pane 243 mechanically activates the self-energizing switch 218. When activated, the energy harvester 222 of the self-energizing sensor 218 powers the wireless transmitter 220, which responsively emits a signal to the receiver 116, for example.

As illustrated in FIG. 2C, at least one self-energizing sensor 318 may be coupled to a sliding window 331 that includes a first window portion 359 and a second window portion 361 that are movable relative to each other. The first window portion 359 and the second window portion 361 are mounted within a frame 341. One self-energizing sensor 318 is coupled to each side of the frame 341, to sense movement of the respective first window portion 359 and the second window portion 361. Movement of the first window portion 359 or the second window portion 361 mechanically activates the respective self-energizing sensor 318. When activated, the energy harvester 322 of the self-energizing sensor 318 powers the wireless transmitter 320, which responsively emits a signal to the receiver 116, for example.

Figure 3A:
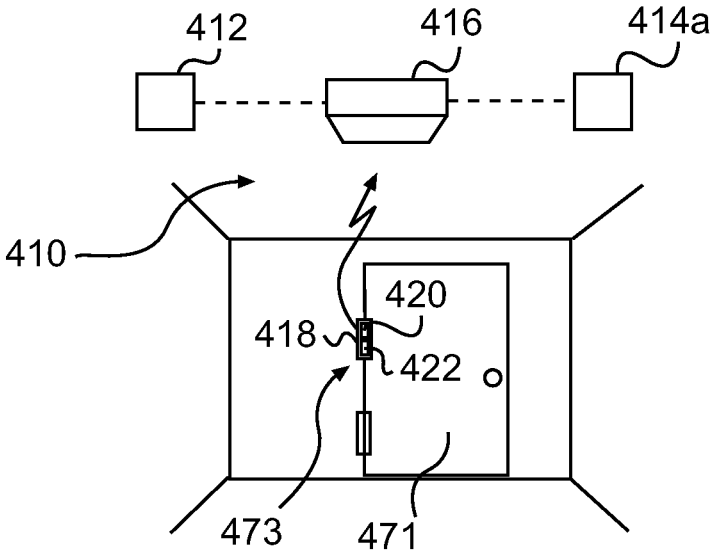
FIG. 3A illustrates an example wireless security system used with a door.

FIG. 3A illustrates another example wireless security system 410 incorporated with a door 471. For example, the door 471 may be a door within the building structure 24 of the example of FIG. 1. A power supply 412 is in selective electrical communication with a security device 414*a*, such as a building light or other device as described in this disclosure. A receiver 416 is electrically connected between the power supply 412 and the security device 414*a* and is operable to selectively electrically connect the security device 414*a* with the power supply 412, as generally described previously. A self-energizing sensor 418 is coupled with the door 471. For example, the self-energizing sensor 418 may be integrated into a hinge 473 of the door 471 such that movement of the door 471 mechanically activates the self-energizing sensor 418. When activated, the energy harvester 422 of the self-energizing sensor 418 powers the wireless transmitter 420, which responsively emits a signal to the receiver 416 to trigger the security device 414*a* to provide a security response, such as illuminating a building light. For instance, opening movement of the door 471 may illuminate the building light bulb and closing movement may shut off the building light bulb.

Figure 3B:
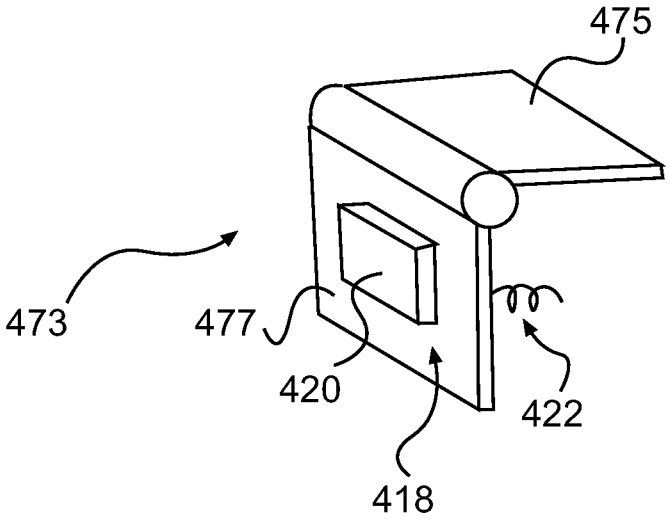
FIG. 3B illustrates an example hinge of the door of FIG. 3A.

FIG. 3B illustrates an example of the hinge 473 of the door 471 that incorporates the self-energizing sensor 418. In this example, the hinge 473 includes a first section 475 that may be fastened to the door 471, and a second section 477 that may be fastened to the surrounding structure of the door 471, such as a door frame. The self-energizing sensor 418 is mechanically coupled with the second section 477, but may alternatively be coupled to the first section 475. Movement of the door 471 mechanically activates the energy harvester 422 to thereby generate power for the wireless transmitter 420. The self-energizing sensor 418 may alternatively be incorporated into other types of hinges and is not limited to the illustrated example. Furthermore, the illustrated example hinge 473 or other types of hinges may be incorporated into other hinged structure, such as hinged window, cabinets, or the like.

Figure 4:
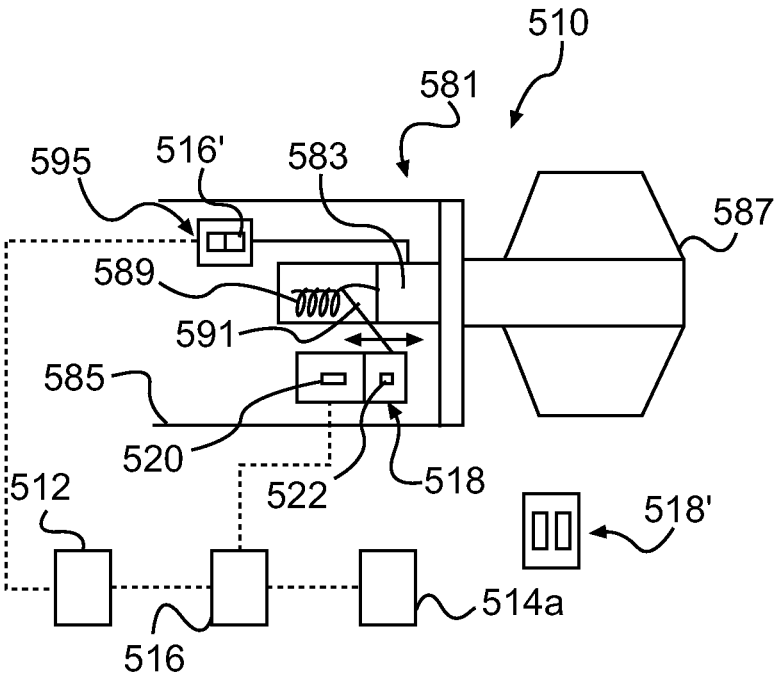
FIG. 4 illustrates an example wireless security system used with a lock.

FIG. 4 illustrates another example wireless security system 510 used with a lock 581. For example, the lock 581 may be incorporated into a door, window, or the like, or into any of the previous examples. In this example, the lock 581 includes a deadbolt 583 at least partially within a lock housing 585. The deadbolt is coupled with an actuator 587 for locking or unlocking the deadbolt 583. The deadbolt 583 may interact with the window, door, or other device in a known manner to provide a locked or unlocked state.

In this example, movement of the deadbolt 583 between locked and unlocked positions respectively compresses and releases a spring 589. The spring 589 is coupled with a self-energizing sensor 518, which includes an energy harvester 522 having an arm 591 that extends near the spring 589 and the deadbolt 583. In some examples, the arm 591 may be coupled to the spring 589, deadbolt 583, or both.

As the deadbolt 583 moves to the left in FIG. 4 the spring 589 compresses, and as the deadbolt 583 moves to the right in FIG. 4 the spring 589 expands. The arm 591 moves left and right with the movement of the spring 589 and the deadbolt 583. Movement of the arm 591 harvests energy from the mechanical movement of the deadbolt 583 to thereby power the wireless transmitter 520 to emit a signal. In response to the signal, the receiver 516 triggers a security response by controlling the electrical connection between the security device 514*a* and the power supply 512. For instance, unlocking or locking the lock 581 may trigger a security response in the form of briefly illuminating a light bulb or emitting a warning sound.

Optionally, the lock 581 may be a powered lock and include an actuator 593 for selectively moving the deadbolt 583 between a locked and unlocked position. For instance, the actuator 593 may be a solenoid or other type of actuator. The actuator 593 may have its own power source, such as a photovoltaic device 595 or be electrically connected with the power supply 512. Alternatively, the photovoltaic device 595 may be a thermal power device, a mechanical power device, or a wind-power device. In this regard, another self-energizing sensor 518' may be selectively manually activated to emit a signal to the receiver 516 or to another similar receiver 516' within the actuator 593, that selectively electrically controls the electrical connection between the photovoltaic device 595 (or the power supply 512) and the actuator 593, to activate the actuator 593 and thereby change the state of the lock 581 between locked and unlocked.

Figure 5:
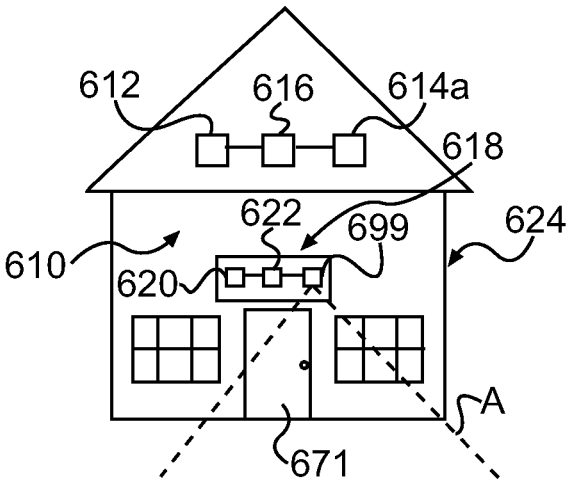
FIG. 5 illustrates an example wireless security system having a motion sensor.

FIG. 5 illustrates another example wireless security system 610 that is incorporated into a building structure 624, such as a residence or commercial building. In this example, a self-energizing sensor 618 is mounted above a door 671, such as an exterior door. In other examples, the self-energizing sensor 618 may alternatively be mounted on the interior of the building structure 624.

The self-energizing sensor 618 includes a motion sensor 699 for sensing motion over an area A corresponding to the door 671. In this example, the energy harvester 622 is a photovoltaic device that harvests external light energy from sunlight or building lights to power the motion sensor 699 and a wireless transmitter 620. For instance, the energy harvester 622 may periodically power the motion sensor 699 such that the motion sensor 699 periodically checks for motion over the area A. In one example, the energy harvester 622 powers the motion sensor only when a threshold amount of energy has been harvested. The threshold amount may be an amount required to power the motion sensor 699 and the wireless transmitter 620. In this regard, the self-energizing sensor 618 may include hardware, software, or both to provide "smart" capability as described previously.

The wireless transmitter 620 emits a signal to the receiver 616. For instance, the signal represents a presence or absence of motion as detected by the motion sensor 699. The receiver 616 may then selectively electrically connect the power supply 612 with the security device 614*a*, depending on the presence or absence of motion. In one example, detected motion triggers a security response in the form of illuminating a light within the building structure 624 to notify an occupant of a possible security event at the door 671.

Figure 6:
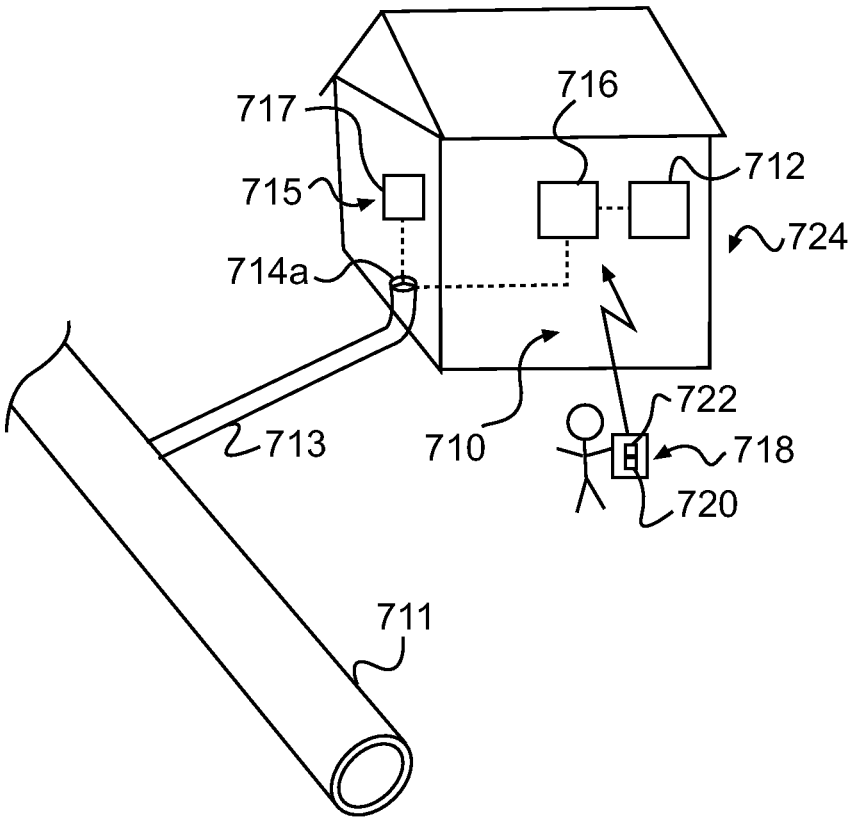
FIG. 6 illustrates an example wireless security system used with a water valve.

FIG. 6 illustrates another example wireless security system 710 incorporated into a building structure 724, such as a residence or commercial building, for security against property damage. In this example, the building structure 724 is fluidly connected with a water main line 711 that supplies water to the building structure 724 through a connecting line 713. The building structure 724 includes a water valve as a security device 714*a*. The water valve is incorporated into the connecting line 713 and is operative to completely close to block the flow of any water from the water main line 711.

In the illustrated example, the water valve is a powered valve 715 that includes an actuator 717 (e.g., solenoid) that is capable of moving the powered valve 715 between a fully open position and a fully closed position. A receiver 716 is electrically connected between a power supply 712 and the powered valve 715.

A self-energizing sensor 718 of the wireless security system 710 includes a wireless transmitter 720 and energy harvester 722 powering the wireless transmitter 720. When activated, the wireless transmitter 720 emits a signal to the receiver 716 to trigger a security response. In this example, the security response is in the form of controlling the open and closed state of the powered valve 715. For example, the self-energizing sensor 718 is actuated to selectively open or close the powered valve 715, to control water flow into the building structure 724. As an example, an individual can shut off the water flow when leaving the building structure 724, to protect against possible flooding. In one possible implementation, the building structure may be a vacation residence, where it would be desirable to easily shut off the water when leaving for a considerable period of time.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A wireless security system comprising:

a power supply;

a security device in selective electrical communication with the power supply, the security device providing a security response when electrically connected with the power supply;

a receiver electrically connected between the power supply and the security device, the receiver selectively electrically connecting the security device with the power supply;

at least one self-energizing sensor including a wireless transmitter and an energy harvester powering the wireless transmitter in response to a security event, the wireless transmitter emitting a signal to the receiver in response to being powered by the energy harvester, to trigger the security response; and a memory module in communication with the receiver and capable of recording an activity pattern of the security device over a time period, wherein the receiver selectively electrically connects the security device with the power supply over another time period to repeat the activity pattern as the security response.

2. The wireless security system as recited in claim 1, wherein the security device includes a building light, and the activity pattern includes alternating ON and OFF states of the building light.

3. The wireless security system as recited in claim 1, wherein the receiver includes the memory module and a software module identifying the signal with the at least one self-energizing switch.

4. The wireless security system as recited in claim 1, wherein the at least one self-energizing sensor is portable such that the security response can be triggered from different locations relative to the receiver and the security device.

5. The wireless security system as recited in claim 1, further comprising a motion sensor powered by the energy harvester, and wherein the energy harvester is a photovoltaic device.

6. The wireless security system as recited in claim 5, wherein the photovoltaic device powers the motion sensor.

7. The wireless security system as recited in claim 1, wherein the at least one self-energizing sensor is mechanically coupled to a building entryway selected from a window and a door.

8. The wireless security system as recited in claim 1, wherein the energy harvester is coupled with a building entryway such that the energy harvester generates the power in response to movement of the building entryway.

9. The wireless security system as recited in claim 1, wherein the at least one self-energizing sensor is coupled with a lock of a building entryway.

10. A method for use with a wireless security system, comprising:

recording in a memory module an activity pattern over a first time period for at least one security device; and selectively electrically connecting, with a wireless receiver, the at least one security device with a power supply to repeat the activity pattern of the first time period over a second time period, wherein the receiver is connected between the power supply and the security device.

11. The method as recited in claim 10, wherein the at least one security device includes a building light, and the activity pattern is a lighting pattern to simulate occupancy in a structure.

12. The method as recited in claim 10, further comprising generating the activity pattern by switching a building light between an ON and OFF states.

13. The method as recited in claim 10, including automatically recording the activity pattern over a predetermined rolling time period.

14. The method as recited in claim 13, including manually triggering the second time period to start, using a self-energizing switch.

* * * * *